US009114417B2

(12) United States Patent
Sakamoto et al.

(10) Patent No.: US 9,114,417 B2
(45) Date of Patent: Aug. 25, 2015

(54) NOZZLE AND FOREIGN MATTER REMOVING DEVICE

(75) Inventors: Takeshi Sakamoto, Tokyo (JP); Kazuaki Takahashi, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 1220 days.

(21) Appl. No.: 12/704,788

(22) Filed: Feb. 12, 2010

(65) Prior Publication Data

US 2010/0206343 A1 Aug. 19, 2010

(30) Foreign Application Priority Data

Feb. 13, 2009 (JP) ..... 2009-030609

(51) Int. Cl.

| | |
|---|---|
| ***B05B 1/14*** | (2006.01) |
| ***B05C 3/04*** | (2006.01) |
| ***B05C 3/10*** | (2006.01) |
| ***B08B 9/093*** | (2006.01) |

(52) U.S. Cl.
CPC ... *B05C 3/04* (2013.01); *B05C 3/10* (2013.01); *B08B 9/0933* (2013.01)

(58) Field of Classification Search
CPC ..... B05C 3/04; B08B 9/0933
USPC ..... 134/104.2, 104.4, 109, 110, 123, 131, 134/184, 186, 198; 239/418, 421, 427, 428, 239/433, 543–544
See application file for complete search history.

(56) References Cited

U.S. PATENT DOCUMENTS

| | | | | |
|---|---|---|---|---|
| 2,964,248 | A | 11/1955 | O'Brien et al. | |
| 3,515,093 | A * | 6/1970 | Greene | 116/137 R |
| 3,599,949 | A * | 8/1971 | Grenfell | 266/89 |
| 3,744,723 | A * | 7/1973 | Davis | 239/543 |
| 4,715,538 | A * | 12/1987 | Lingnau | 239/248 |
| 5,092,356 | A * | 3/1992 | Grot | 134/167 R |
| 6,139,708 | A * | 10/2000 | Nonomura et al. | 204/482 |
| 6,354,515 | B1 | 3/2002 | Matsumoto et al. | |
| 7,229,541 | B2 * | 6/2007 | Hara et al. | 204/471 |
| 2004/0164189 | A1 | 8/2004 | Berning et al. | |
| 2008/0311010 | A1 | 12/2008 | Boe | |

FOREIGN PATENT DOCUMENTS

| | | |
|---|---|---|
| EP | 1 325 782 A2 | 7/2003 |
| JP | 1-106573 U | 7/1989 |

(Continued)

OTHER PUBLICATIONS

Machine translation of JP2004018957A, dated Jan. 2004.*

(Continued)

*Primary Examiner* — Michael Barr
*Assistant Examiner* — Kevin G Lee
(74) *Attorney, Agent, or Firm* — Squire Patton Boggs (US) LLP

(57) ABSTRACT

A nozzle for forming a jet stream in a tank filled with a liquid, including a first injection hole for obliquely generating a first jet stream with respect to a bottom of the tank and a second injection hole for generating a second jet stream at an angle shallower than an angle at which the first jet stream is generated with respect to the bottom of the tank.

9 Claims, 8 Drawing Sheets

(56) References Cited

FOREIGN PATENT DOCUMENTS

| | | | | | |
|---|---|---|---|---|---|
| JP | 01212798 | A | * | 8/1989 | ..... C25D 13/22 |
| JP | 03-43240 | | | 9/1991 | |
| JP | 2001-129313 | A | | 5/2001 | |
| JP | 2001129313 | A | * | 5/2001 | ..... B01D 21/24 |
| JP | 2004018957 | A | * | 1/2004 | |
| JP | 2007-144377 | | | 6/2007 | |
| JP | 2009-297603 | A | | 12/2009 | |

OTHER PUBLICATIONS

UK Combined Search and Examination Report application No. GB1002506.2 dated May 10, 2010.

* cited by examiner

NOZZLE AND FOREIGN MATTER REMOVING DEVICE

CROSS REFERENCE TO RELATED APPLICATIONS

This application claims the foreign priority benefit under 35 U.S.C. §119 of Japanese Patent Application No. 2009-030609 filed on Feb. 13, 2009, the disclosure of which is incorporated herein by reference.

BACKGROUND OF THE INVENTION

1. Field of the Invention

The present invention relates to a nozzle used in a liquid and a foreign matter removing device provided with the nozzle.

2. Description of the Related Art

After a vehicle body is subjected to a predetermined welding process, the vehicle body is generally subjected to a coating pretreatment including a washing treatment, a degreasing treatment, a surface control treatment and a chemical conversion treatment. The vehicle body is then subjected to electrodeposition coating, intermediate coating and top coating.

In a coating pretreatment, a vehicle body is dipped in each tank of multiple tanks (dip tank) filled with treatment liquids in order. As a result, foreign matter which is stuck on the vehicle body such as iron powder or spatter is removed from the vehicle body, and the foreign matter settled in the treatment liquids is arranged on the bottom of each tank.

The electrodeposition coating is performed by dipping the vehicle body in a tank filled with a treatment liquid including electrodeposition paint. At this time, a pigment composition of the electrodeposition may be settled and arranged on the bottom of the tank.

However, foreign matter or a pigment composition (may be refereed to just as "foreign matter" including a pigment composition hereinafter) arranged on the bottom of the tank may be whirled up by the movement of the vehicle body in the treatment liquid or by natural convection current of the treatment liquid and may be stuck on the vehicle body. The foreign matter stuck on the vehicle body may cause painting defect.

To solve the problem, there are foreign matter removing devices for removing foreign matter arranged on the bottom of a tank outside the tank. Such a foreign matter removing device includes, for example, a hopper which is provided on the bottom of the tank for collecting foreign matter; a plurality of nozzles which injects a treatment liquid toward the hopper in a treatment liquid stored in a tank to collect the foreign matter in the hopper; a circulation pathway for discharging the treatment liquid which contains the foreign matter from the tank via the hopper and separates and returns only the treatment liquid to the nozzle. With such a foreign matter removing device, it is possible to remove the foreign matter settled on the bottom of the tank outside of the tank, which prevents the foreign matter from stacking on the vehicle body in the tank.

An ejector nozzle (see Japanese utility model application No. H03-43240) and a sectorial jetting nozzle (see Japanese patent application publication No. 2007-144377) have been conventionally known as a nozzle used in a liquid.

These ejector nozzle and sectorial jetting nozzle have been known to agitate a liquid stored in a tank. More specifically, the ejector nozzle prevents an electrodeposition paint in an electrodeposition liquid stored in an electrodeposition bath from being settled. In this ejector nozzle, the injecting pattern of the electrodeposition liquid is substantially a conic shape due to its ejector action.

The sectorial jetting nozzle is used for removing a grinding dust included in a coolant which has been used for, for example, metallic processing, by using foam separation. The sectorial jetting nozzle includes a plurality of injection holes arranged in a fan shape so that a bubble-mixed stream is formed in a wide range in the coolant filled in a tank.

In such a foreign matter removing device, however, foreign matter needs to be collected in a hopper without whirling up the foreign matter arranged on the bottom of a tank. Thus, conventional nozzles (see Japanese utility model application No. H03-43240 and Japanese patent application publication No. 2007-144377) which agitate a liquid (the electrodeposition liquid or coolant) can not be used in the foreign matter removing device.

Furthermore, conventional nozzles which agitate a liquid can not move the foreign matter toward a hopper efficiently since direct advancing property of the jet stream in a liquid is weak in the conventional nozzles. In the conventional nozzles, if the amount of liquid supplied to the nozzle is increased to move the foreign matter toward the hopper efficiently, not only the amount of upflung foreign matter is increased but also the size of a pump which supplies a liquid to the nozzle becomes larger, which results in increase in the manufacturing cost of the foreign matter removing device.

SUMMARY OF THE INVENTION

The present invention has been made in view of the above problem, and an object thereof is to provide a nozzle which is capable of forming a jet stream having an excellent direct advancing property and flowing along the bottom of a tank filled with a liquid without whirling up foreign matter arranged on the bottom of the tank, and a foreign matter removing device which uses the nozzle.

A first aspect of the present invention provides a nozzle for forming a jet stream in a tank filled with a liquid. The nozzle includes a first injection hole for obliquely generating a first jet stream with respect to a bottom of the tank; and a second injection hole for generating a second jet stream at an angle shallower than an angle at which the first jet stream is generated with respect to the bottom of the tank.

In the aforementioned nozzle, it is preferable that the first injection hole extends straight, the second injection hole extends straight side by side with the first injection hole below the first injection hole and is bent upward at a portion of the first injection hole and further extends straight, and a tip opening of the first injection hole is arranged above a tip opening of the second injection hole.

In the aforementioned nozzle, it is also preferable that the nozzle includes two second injection holes, and the two second injection holes extend side by side on both sides of the first injection hole in a plan view, and the two second injection holes are arranged in a fan shape expanding and separated outward from base end sides to front end sides of the two second injection holes in the plan view.

A second aspect of the present invention provides a foreign matter removing device for removing foreign matter settled on a bottom of a tank filled with a liquid. The foreign matter removing device includes a hopper for collecting the foreign matter provided on the bottom of the tank; a nozzle for generating a jet stream for moving the foreign matter toward the hopper, the nozzle being provided on the bottom of the tank; a circulation passage for separating a liquid from the foreign matter and the liquid which have been drained from the tank through the hopper and returning the liquid to the nozzle. The nozzle includes a first injection hole for obliquely generating a first jet stream with respect to the bottom of the tank; and a second injection hole for generating a second jet stream at an angle shallower than an angle at which the first jet stream is generated with respect to the bottom of the tank.

In the aforementioned foreign matter removing device, it is preferable that the foreign matter removing device further includes a guide groove on the bottom of the tank which extends toward the hopper and of which one end is connected to the hopper, and the guide groove is shaped in a circular arch in a cross section, and the nozzle is disposed at substantially middle of the guide groove in a width direction of the guide groove.

DETAILED DESCRIPTION OF THE PREFERRED EMBODIMENTS

An embodiment of the present invention is described in detail below with reference to the accompanying drawings. A main characteristic of a nozzle of the present invention is that the nozzle forms in a liquid at least two jet streams at the same time whose injection directions are different for improving the direct advancing property of the jet streams. A main characteristic of a foreign matter removing device of the present invention is that the foreign matter removing device is equipped with this nozzle. The foreign matter removing device is described first, and the nozzle is described next in this specification.

(Foreign Matter Removing Device)

Figure 1:
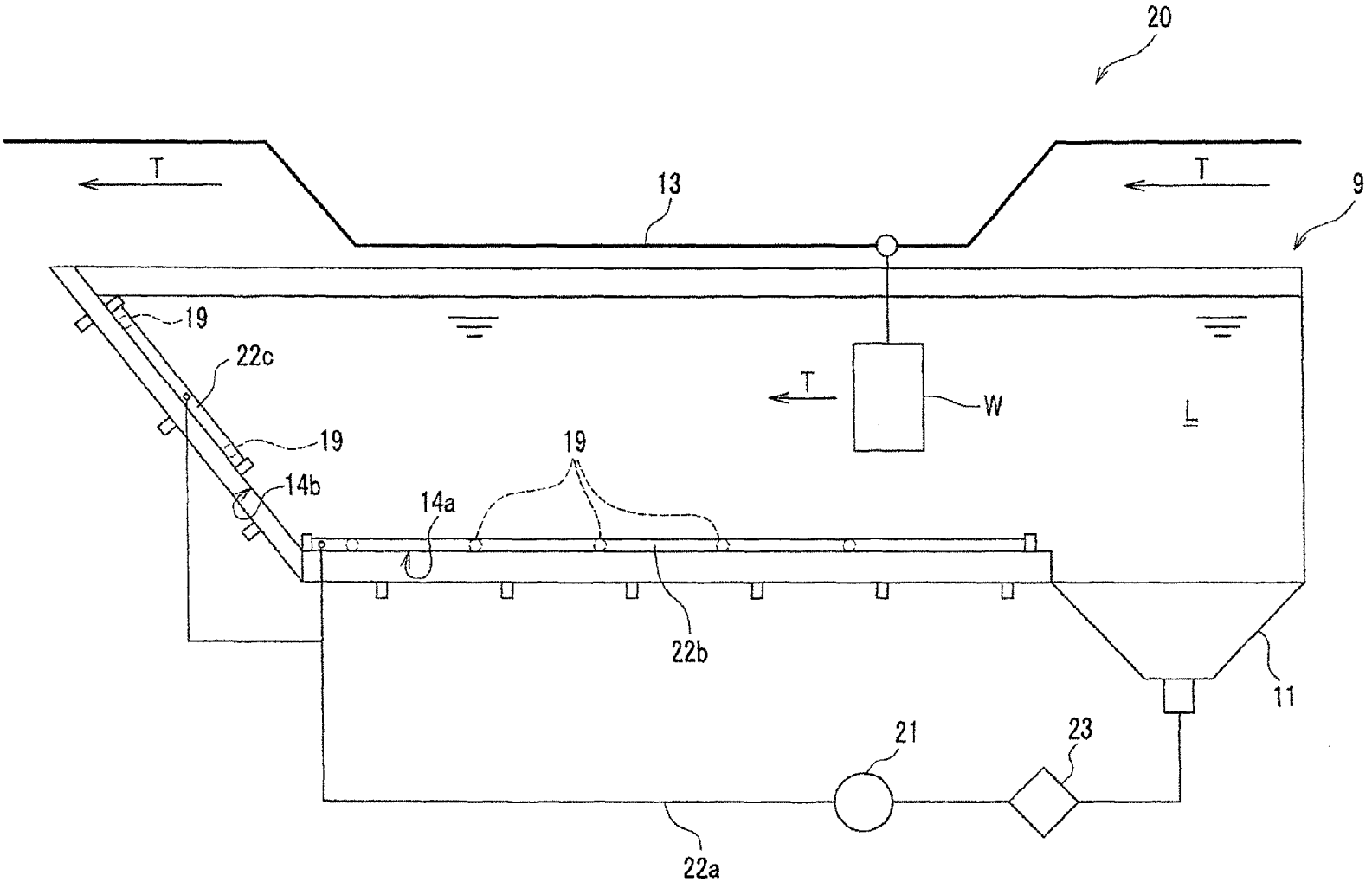
FIG. 1 is a side view of a foreign matter removing device according to the present invention for explaining a configuration of the foreign matter removing device.

As shown in FIG. 1, a foreign matter removing device 20 removes foreign matter (omitted in FIGS. 1 to 8) which is settled on the bottom of a tank 9 filled with a liquid L. The liquid L here is a liquid in which a work W is dipped for a predetermined treatment, and the liquid L may be changed appropriately depending on the type of the work W and a kind of a treatment applied to the work W. An embodiment of the foreign matter removing device 20 is described where the work W is a vehicle body and the liquid L is a washing fluid for the work W, however, the present invention is not limited to this. The present invention can be used in any treatment in which foreign matter is settled on the bottom of the tank 9 by dipping the work W in the liquid L.

The foreign matter removing device 20 includes: a hopper 11 (a collecting unit) provided on the bottom of the tank 9; a plurality of nozzles 1 (described later, see FIG. 2) which is disposed on the bottom of the tank 9; a circulation pathway 22 which separates the liquid L from foreign matter and the liquid L drawn from the tank 9 via the hopper 9 and feeds the liquid L to the nozzle 1.

Disposed above the tank 9 is a transportation conveyer 13 which hangs and transports the work W. The transportation conveyer 13 is configured to lower the work W when the transportation conveyer 13 transports the work W from one end of the tank 9 to the other end thereof along the transport direction T. The lowered work W moves in the liquid L from the one end of the tank 9 to the other end thereof.

The hopper 11, a horizontal part 14*a* which is substantially horizontal, and an inclined part 14*b* which is inclined upward in the transport direction T are formed on the bottom of the tank 9 in this order from the upstream side to the downstream side of the transport direction T.

The hopper 11 is configured to collect foreign matter settled in the liquid L filled in the tank 9. The hopper 11 has a funnel shape which is open at the top, and an end of the circulation pathway 22 (an outside pipe 22*a*, which will be described later) is connected to the bottom of the hopper 11.

Figure 2:
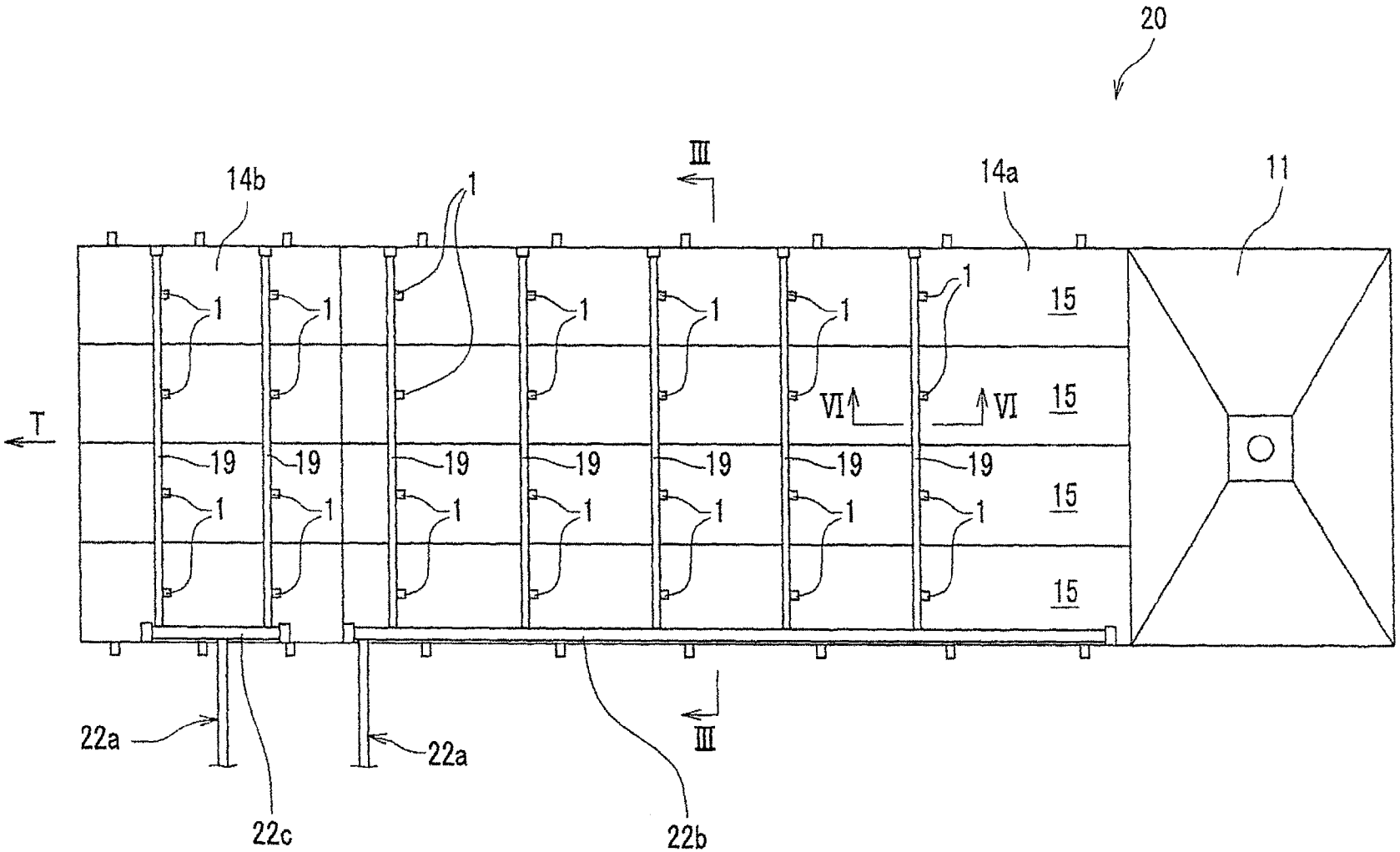
FIG. 2 is a plan view of the foreign matter removing device according to the present invention seen from above for explaining the configuration of the foreign matter removing device.

As shown in FIG. 2, the horizontal part 14*a* and the inclined part 14*b* which constitute the bottom of the tank 9 includes four guide grooves 15 which are parallel to one another. Each guide groove extends along the transport direction T, and an end thereof is connected to the hopper 11.

Figure 3A:
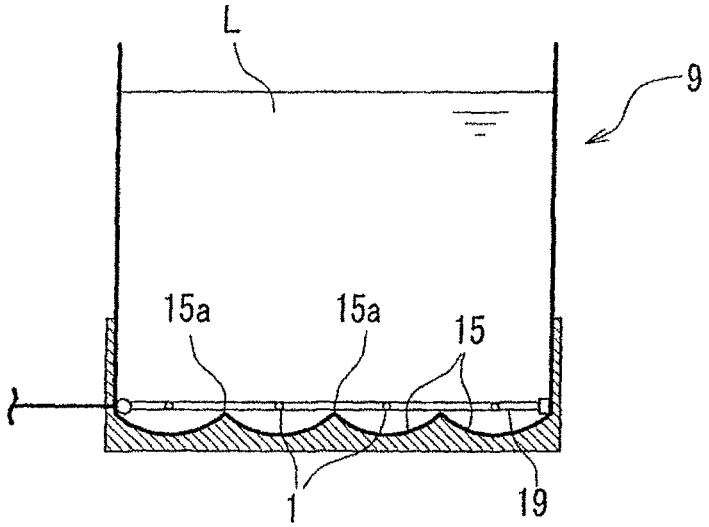
FIG. 3A is a schematic cross sectional view along the line III-III in FIG. 2.
Figure 3B:
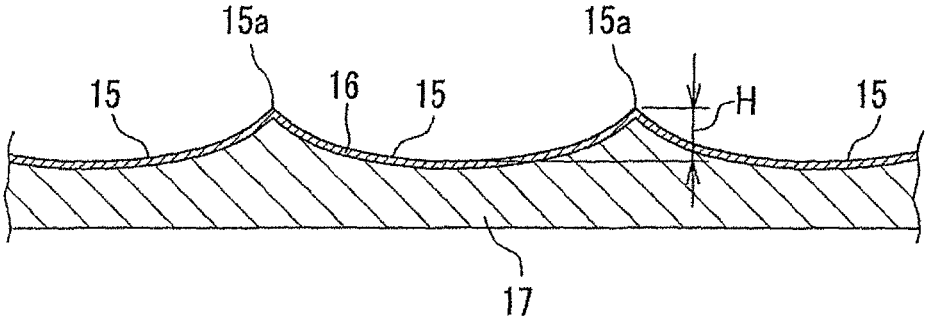
FIG. 3B is a partial enlarged view of the bottom of the tank shown in FIG. 3A.

As shown in FIGS. 3A and 3B, each guide groove 15 has a circular concave shape in a cross-section, and a side edge 15*a* which is shared by adjacent guide grooves 15 protrudes upward. The cross sectional shape of the guide groove 15 in this embodiment is preferably a lower part of a circle whose depth H is equal to or shorter than the radius of the circle, or a lower part of an ellipse whose vertical direction is its minor axis direction and whose depth H is equal to or shorter than half of the minor axis of the ellipse. The ratio of the long axis to the short axis of the ellipse (long axis/short axis) is preferably more than 1 and equal to or less than 8. The reference numeral 9 in FIG. 3A refers to a tank, and the reference symbol L refers to a liquid filled in the tank 9.

The bottom of the tank 9 (see FIG. 3A) on which a plurality of guide grooves 15 is formed can be formed by press forming, for example, steel plate member 16 (see FIG. 3B). The reference numeral 17 in FIG. 3B refers to a reinforcing member which reinforces the outline of the press formed steel plate member 16 from its back side.

The circulation pathway 22 includes, as shown in FIGS. 1 and 2, an outside pipe 22*a*, a horizontal supply pipe 22*b*, an inclined supply pipe 22*c* and distribution pipes 19.

As shown in FIG. 1, an end of the outside pipe 22*a* is connected to a lower part of the hopper 11, and the other end of the outside pipe 22*a* is forked into two braches, which are connected to the inclined supply pipe 22*c* and the horizontal supply pipe 22*b*, respectively. The outside pipe 22*a* is provided with a filter 23 and a circulation pump 21. The filter 23 separates (passes) only the liquid L from the foreign matter and the liquid L which have been drained from the tank 9 via the hopper 11 and disposes the foreign matter through a predetermined passage. The circulation pump 21 drains the foreign matter and the liquid L from the tank 9 via the hopper 11, and feeds the liquid L separated by the filter 23 to the inclined supply pipe 22*c* and the horizontal supply pipe 22*b* through the outside pipe 22*a*.

As shown in FIG. 2, the horizontal supply pipe 22*b* is disposed along a width directional side of the horizontal part 14*a*, and the inclined supply pipe 22*c* is disposed along a width directional side of the inclined part 14*b*. Both ends of the horizontal supply pipe 22*b* and both ends of the inclined supply pipe 22*c* are sealed.

The plurality of the distribution pipes 19 is arranged on the bottom of the tank 9 such that the distribution pipes 19 extend in a width direction (a width direction of the guide grooves 15) as shown in FIG. 2. An end of each distribution pipe 19 is connected to the inclined supply pipe 22*c* or the horizontal supply pipe 22*b*, and the other end thereof is sealed. Two distribution pipes 19 are connected to the inclined supply pipe 22*c* of the embodiment with a predetermined distance spaced in the extending direction of the guide grooves 15. Five distribution pipes 19 are connected to the horizontal supply pipe 22*b* with a predetermined distance spaced in the extending direction of the guide grooves 15. It is to be noted that each distribution pipe 19 is in contact with protruded portions of the side edges of the guide grooves 15 as shown in FIG. 3A. The distribution pipe 19 is omitted in FIG. 3B.

Each distribution pipe 19 is provided with a plurality of nozzles 1 as shown in FIG. 2. In this embodiment, each distribution pipe 19 is provided with four nozzles 1 according to the number of the guide grooves 15 (one nozzle for one guide groove). More specifically, the nozzle 1 is attached to a portion of the distribution pipe 19 which is right above the center of the guide groove 15 in the width direction of the guide groove 15 as shown in FIGS. 2, 3A and 3B. The nozzle 1 is arranged such that the nozzle 1 forms a jet stream toward the hopper 11, as described later.

(Nozzle)

Figure 4:
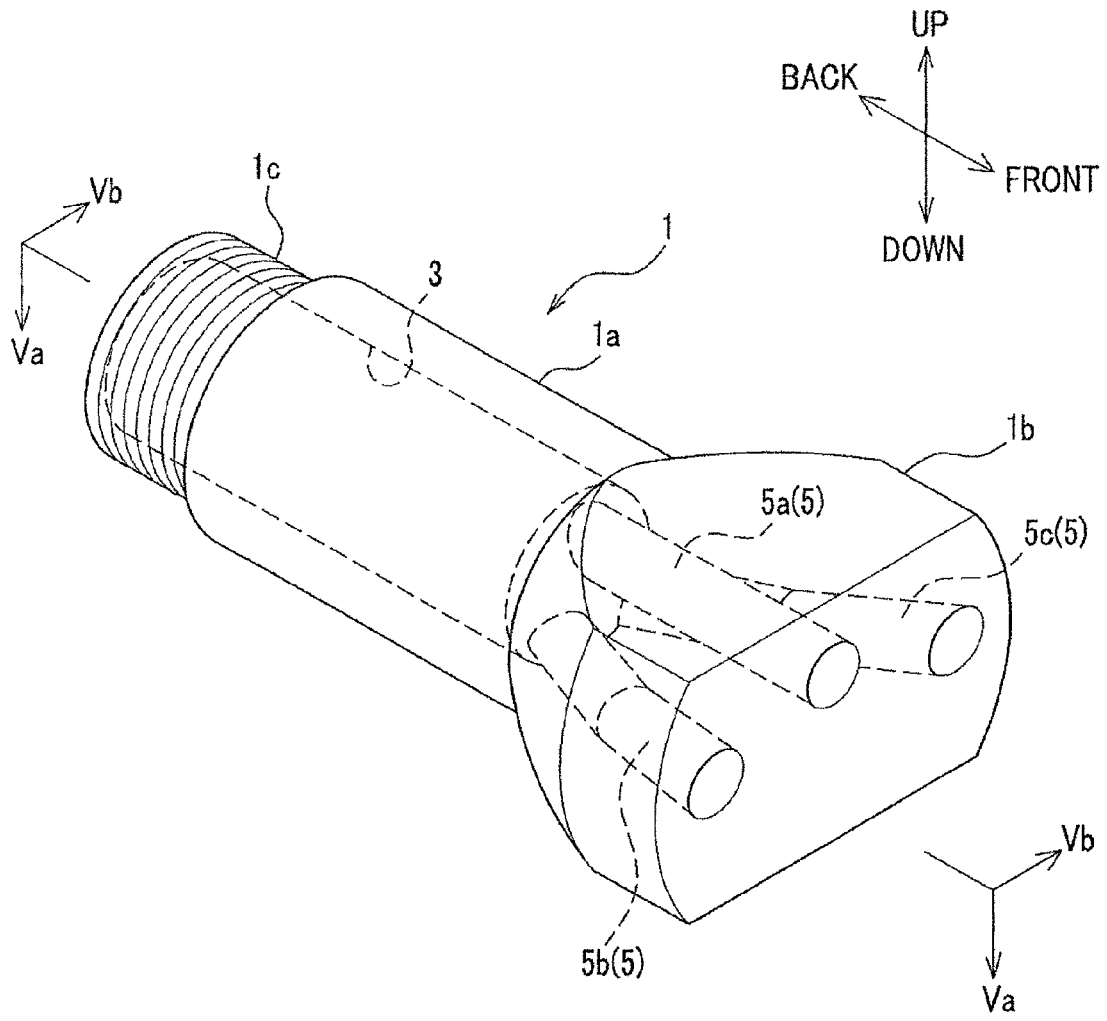
FIG. 4 is a perspective view of a nozzle of the present invention.

As shown in FIG. 4, the nozzle 1 includes a back half body 1*a* which is attached to the distribution pipe 19 (see FIG. 2) and a front half body 1*b* including an injection hole 5. The front-back direction and the up-down direction used in the following description is the same as those shown in FIG. 6 where the front direction is the hopper 11 (see FIG. 2) side of the nozzle 1 when the nozzle 1 is attached to the distribution pipe 19, and the upper direction is the side of the surface (fluid surface) of the liquid L in the tank 9 (see FIG. 3A).

The back half body 1*a* of the nozzle 1 has a cylindrical shape. A screw portion 1*c* is formed on the back side of the back half body 1*a* for fixing the nozzle 1 to the distribution pipe 19. Formed inside of the back half body 1*a* is a flowing hole 3 through which the liquid L (see FIG. 2) flows which has been supplied through the distribution pipe 19 (see FIG. 2).

Figure 5A:
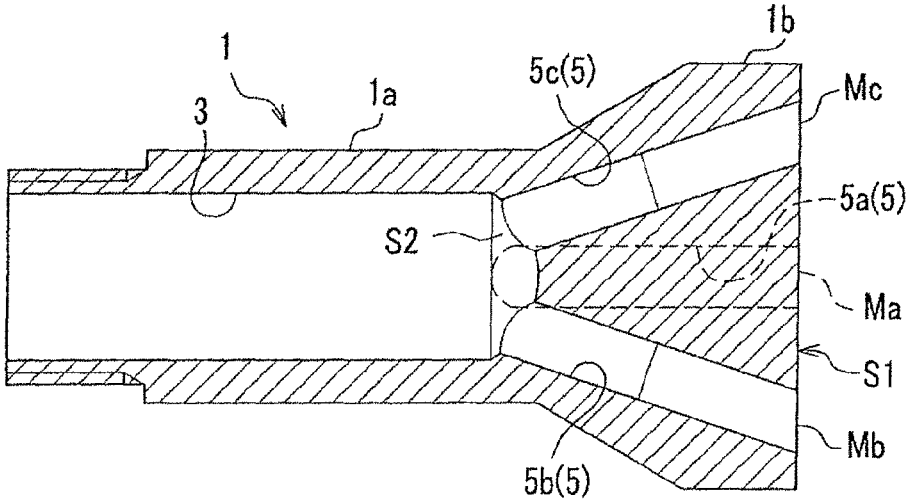
FIG. 5A is a cross sectional view along the line Va-Va in FIG. 4.
Figure 5B:
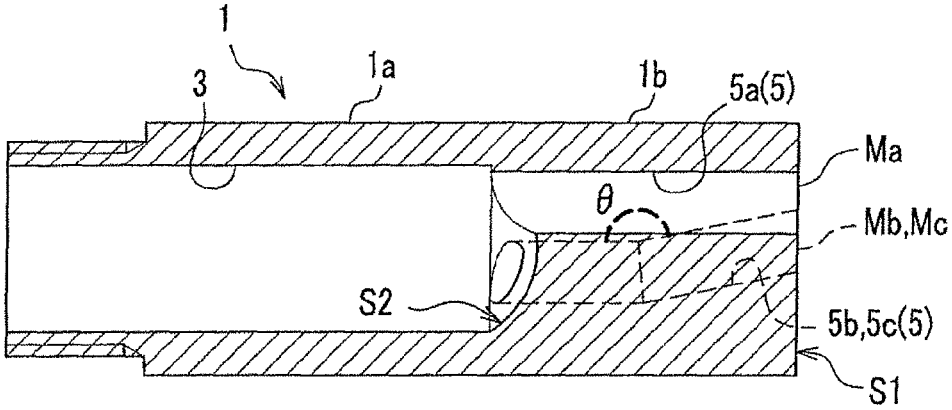
FIG. 5B is a cross sectional view along the line Vb-Vb in FIG. 4.

As shown in FIG. 5A, the front half body 1*b* has substantially fan-shape in a plan view in which the width of the front half body 1*b* becomes gradually larger than that of the back half body 1*a* toward the front side of the front half body 1*b*. As shown in FIG. 5B, a front half body 1*b* in a side view extends frontward with its thickness unchanged, which is substantially the same as the external diameter of the back half body 1*a*.

Three injection holes 5 are provided to the front half body 1*b*. The three injection holes 5 include an injection hole 5*a*, which is also referred to as a first injection hole, an injection hole 5*b* and an injection hole 5*c*, which are also referred to as a second injection hole.

Figure 5C:
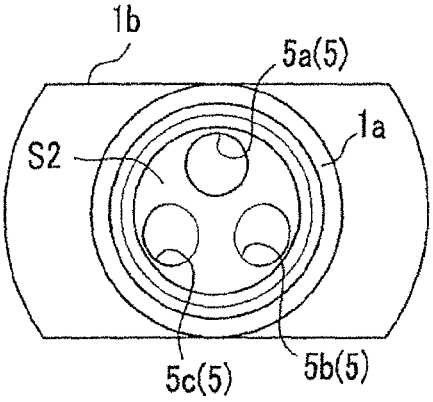
FIG. 5C is a back side view of a nozzle of the present invention.
Figure 5D:
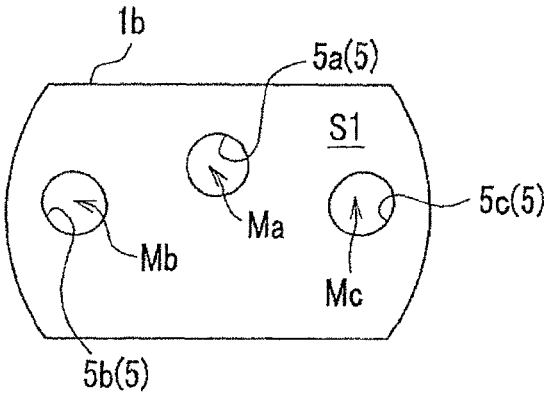
FIG. 5D is a front view of the nozzle.

These injection holes 5*a*, 5*b* and 5*c* are branched from the front end of the flowing hole 3 formed in the back half body 1*a* as shown in FIGS. 5A, 5B and 5C. As shown in FIGS. 5A, 5B and 5D, the injection holes 5*a*, 5*b* and 5*c* penetrates through the front half body 1*b* and forms tip openings Ma, Mb and Mc, respectively, at the front end surface S1 of the front half body 1*b*. The injection holes 5*a*, 5*b* and 5*c* are branched from the flowing hole 3 at the boundary surface S2 (see FIGS. 5B and 5C). The boundary surface S2 is formed as a spherical surface which protrudes in the front direction of the nozzle 1.

Next, the injection holes 5*a*, 5*b* and 5*c* are further described in detail.

As shown in FIG. 5A, the injection holes 5*a*, 5*b* and 5*c* are arranged in such a manner that the injection hole 5*b* and the injection hole 5*c* extend side-by side on both sides of the injection hole 5*a* in a plan view. The injection hole 5*b* and the injection hole 5*c* are arranged in a fan shape in which the injection hole 5*b* and the injection hole 5*c* are separated outward from the back side to the front side of the front half body 1*b* (i.e. from base ends to tip sides of the injection holes 5*a*, 5*b* and 5*c*).

The injection hole 5*a* is formed in a linear shape as shown in FIGS. 5A and 5B. More specifically, the injection hole 5*a* linearly extends in the same direction as the extending direction of the flowing hole 3 formed in the back half body 1*a*. As shown in FIG. 5C, the base ends of the injection holes 5*a*, 5*b* and 5*c* are arranged to form a equilateral triangle (when seen from the back side of the nozzle 1) on the boundary surface S2 where the base ends of the injection holes 5*a*, 5*b*, 5*c* are branched from the flowing hole 3. The base end of the injection hole 5*a* is disposed above the base ends of the injection hole 5*b* and the injection hole 5*c* which are arranged horizontally to each other.

As shown in FIGS. 5A and 5B, the injection hole 5*b* and the injection hole 5*c* extend straight below the first injection hole 5*a* side by side with the first injection hole 5*a*. The injection hole 5*b* and the injection hole 5*c* are bent upward in an obtuse angle δ at some portions of the injection hole 5*b* and the injection hole 5*c* and further extend linearly from the bent portions. The flex angle δ may be any angle as long as the flex angle δ is more than 90 degree and less than 180 degree, however, the flex angle δ is preferably in a range from 170 degree to 172 degree, and 171 degree is particularly desirable.

As shown in FIG. 5D, the tip opening Ma of the injection hole 5*a* according to the embodiment is positioned above the tip openings Mb and Mc of the injection holes 5*b* and 5*c*.

Figure 6:
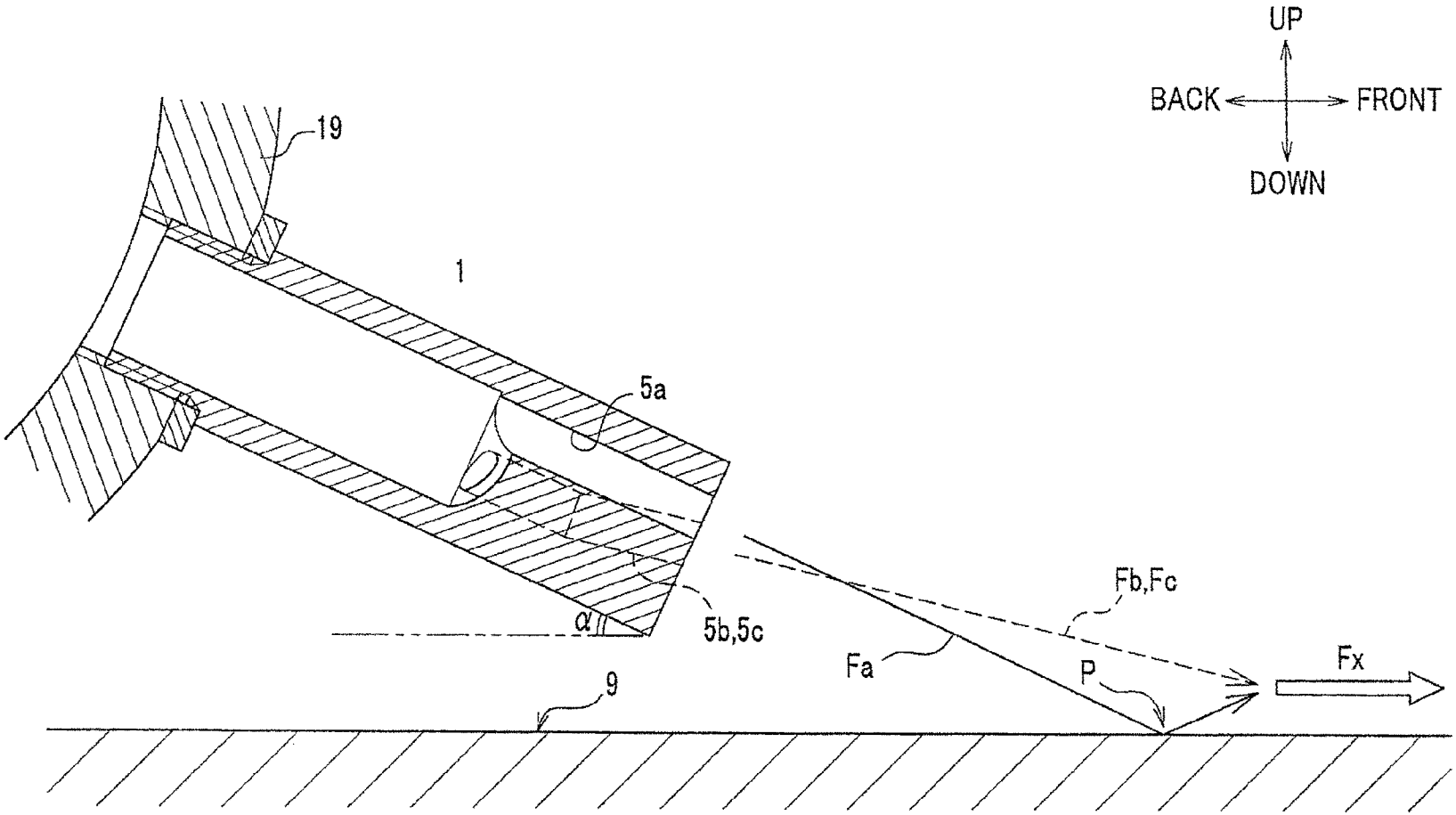
FIG. 6 is a side cross sectional view of the nozzle along the line IV-IV in FIG. 2.

As shown in FIG. 6, the nozzle 1 is attached to the distribution pipe 19 (see FIG. 2) at a predetermined angle α with respect to the bottom of the tank 9 so that the injection hole 5*a* forms a first jet stream Fa which is obliquely generated to the bottom of the tank 9. This angle α is preferably from 20 degree to 25 degree.

In the above described nozzle 1, the injection hole 5*a* forms a first jet stream Fa which is obliquely generated to the bottom of the tank 9, and the injection hole 5*b* and 5*c* forms second jet streams Fb and Fc which are generated to the bottom of the tank 9 at an angle shallower than that of the first jet stream Fa with respect to the bottom of the tank 9.

Next, an operation of the foreign matter removing device 20 using the nozzle 1 according to the embodiment is described.

As shown in FIG. 1, when the work W is dipped in the liquid L and is moved, the work W is subjected to a predetermined treatment (e.g. washing treatment). During the treatment, foreign matter, such as iron powder or a sputter, stuck to the work W is settled on the bottom of the tank 9.

When the circulation pump 21 shown in FIG. 1 is activated, the foreign matter in the hopper 11 is drained into the outside pipe 22*a* together with the liquid L from the lower part of the hopper 11. The liquid L which is separated from the foreign matter by the filter 23 is supplied to the horizontal supply pipe 22*b* and the inclined supply pipe 22*c* through the outside pipe 22*a*. After the liquid L is supplied to the horizontal supply pipe 22*b* and the inclined supply pipe 22*c*, the liquid L (omitted in FIG. 2) is generated from the nozzles 1 through each distribution pipe 19 shown in FIG. 2.

Figure 7:
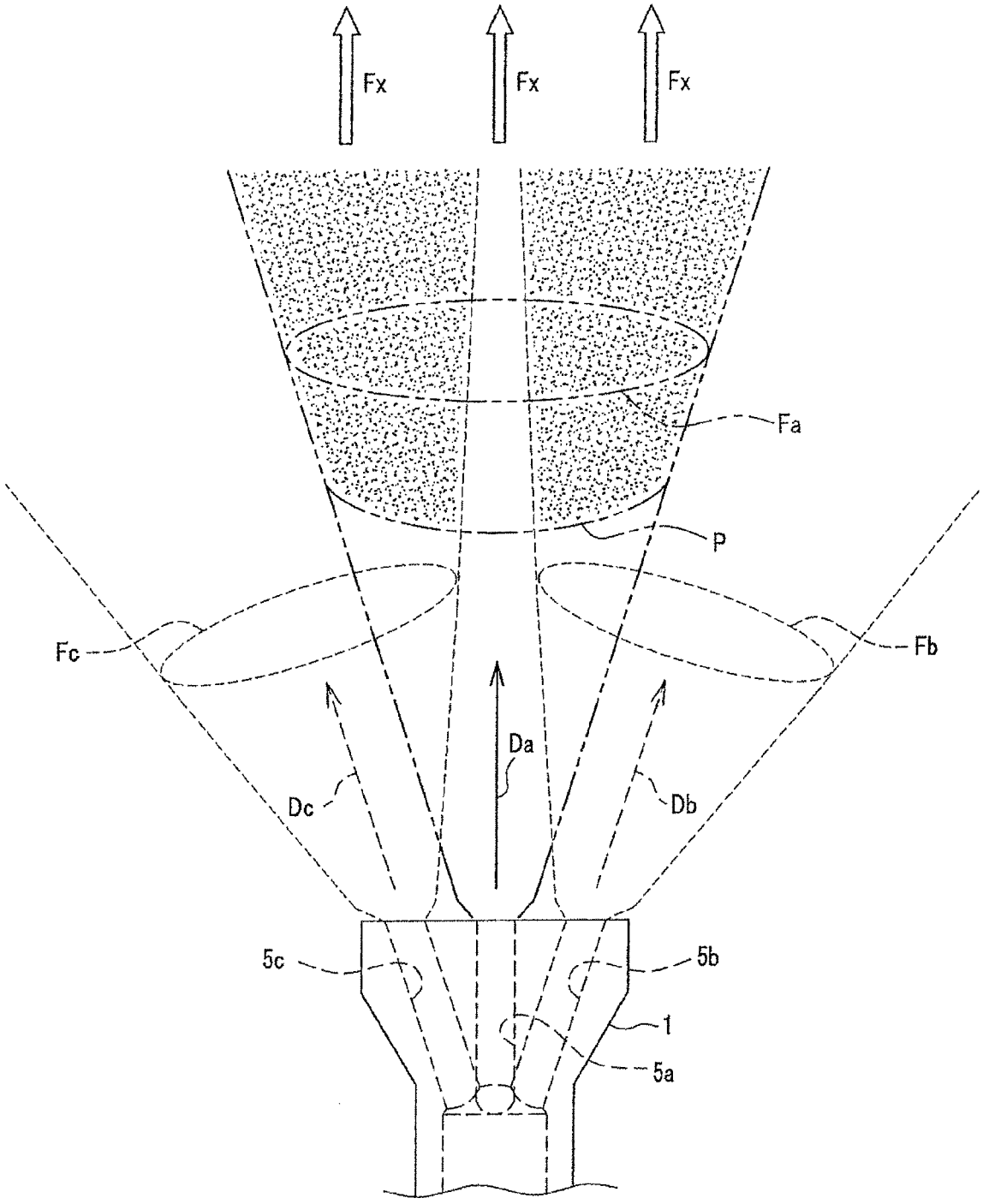
FIG. 7 is a schematic plan view of jet streams generated from the nozzle.

Since the injection holes 5*a*, 5*b*, 5*c* of the nozzle 1 are arranged in a fan shape where the injection holes 5*b*, 5*c* are expanded and separated outward in a plan view as shown in FIG. 7, the injection directions Da, Db, Dc of the liquid L (omitted in FIG. 7) are also expanded in a fan-shape in a plan view. The liquid L injected in each injection direction Da, Db, Dc forms an induction flow which mainly combines the liquid L around the injected liquid L. Thus, the injection hole 5*a* forms a first jet stream Fa whose diameter is enlarged than that of the tip opening Ma (see FIG. 5D) of the injection hole 5*a*. The injection holes 5*b*, 5*c* form second jet streams Fb, Fc whose diameter is enlarged than that of the tip openings Mb and Mc of the injection holes 5*b*, 5*c* (see FIG. 5D), respectively.

On the other hand, since the nozzle 1 injects the second jet streams Fb, Fc at an angle shallower than that of the first jet stream Fa as shown in FIG. 6, the first jet stream Fa which is obliquely injected to the bottom of the tank 9 and is reflected by the bottom of the tank 9 is redirected to the bottom of the tank 9 by the second jet streams Fb, Fc. Thus, the first jet stream Fa and the second jet streams Fb, Fc are combined, which forms a combined jet stream Fx flowing along the bottom of the tank 9 which has an excellent advancing property. The combined jet stream Fx suppresses whirling of a foreign matter which is arranged on the bottom of the tank 9. The combined jet stream Fx is formed in an area in which the second jet streams Fb, Fc are overlapped with the first jet stream Fa as shown in FIG. 7. More specifically, the area is more front than a position P at which the first jet stream Fa is reflected by the bottom of the tank 9 (see FIG. 6 as well).

Figure 8:
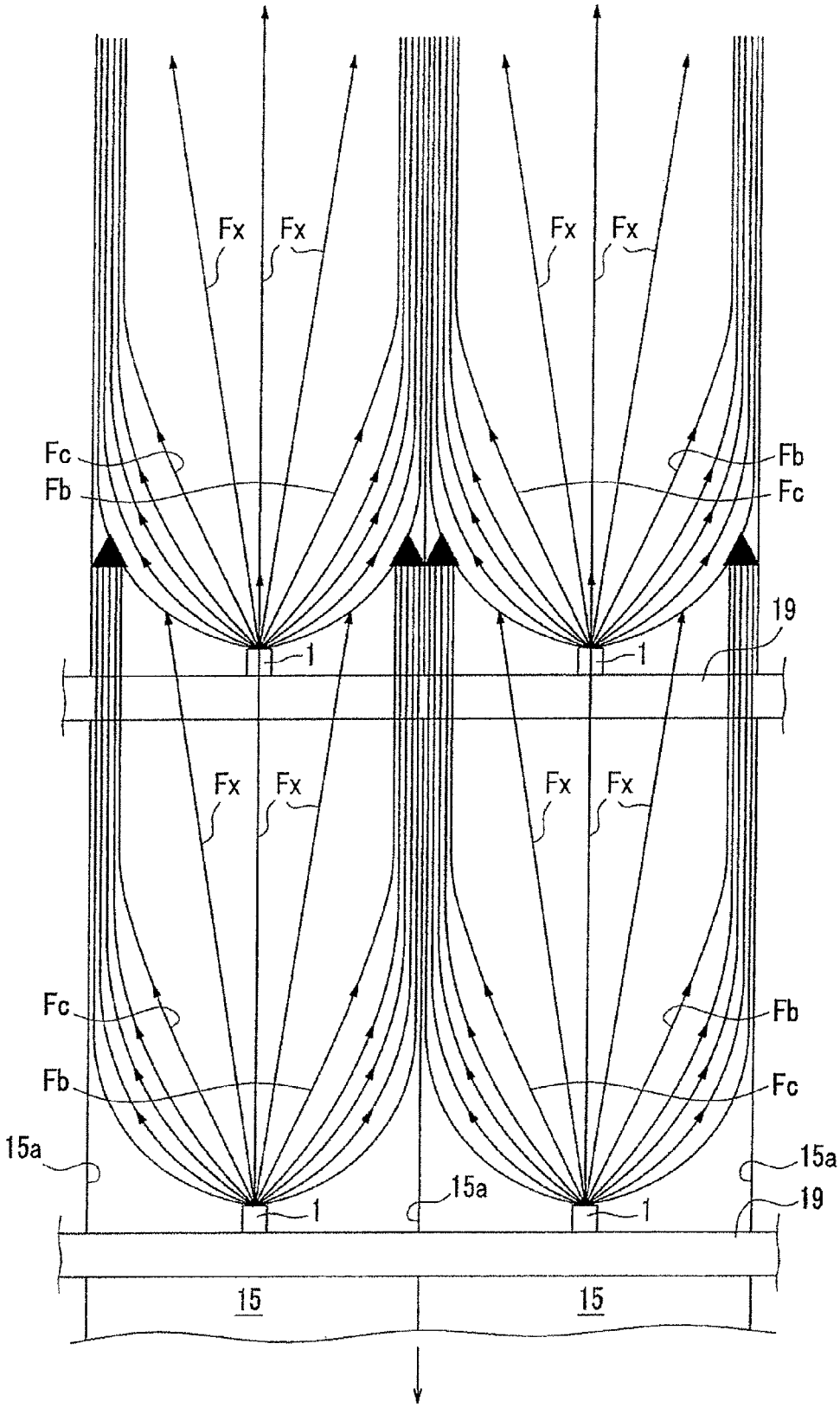
FIG. 8 is a schematic view of the jet streams generated from the nozzle and flowing along guide grooves which are formed on the bottom of a tank seen from above.

As shown in FIG. 8, in the foreign matter removing device 20 with which the nozzle 1 is provided at substantially center of the guide groove 15 in the width direction, the combined jet stream Fx having an excellent advancing property flows frontward (i.e. to the side of the hopper 11 (see FIG. 2)) along the bottom of the circular guide grooves 15.

On the other hand, parts of the second jet streams Fb, Fc which are not overlapped with the first jet stream Fa, flow frontward in such a manner that the parts of the second jet streams Fb, Fc are expanded and separated outward in the width direction of each guide groove 15, and reach the bottom of the guide groove 15. The second jet streams Fb, Fc which are reflected by the bottom of the guide groove 15 flow outward in the width direction along the circular shape (in a cross-section) of the guide groove 15. The second jet streams Fb, Fc are then guided by the side edge 15*a* of the guide groove 15 which protrudes upward, and flow frontward along the side edge 15*a*.

Thus, the foreign matter which is settled on the bottom of the guide groove 15 is moved toward the hopper 11. The foreign matter collected in the hopper 11 is drawn into the outside pipe 22*a* from the lower part of the hopper 11 together with the liquid L. The liquid L which has passed the filter 23 is returned to the nozzle 1 via the circulation pathway 22. The foreign matter which has been filtered by the filter 23 is disposed from the filter 23 through a predetermined path 3.

In accordance with the above-described nozzle 1, foreign matter settled on the bottom of the tank 9 is moved in the flowing direction of the first jet stream Fa by the first jet stream Fa injected obliquely with respect to the bottom of the tank 9. The first jet stream Fa reflected by the bottom of the tank 9 is deflected downward by the second jet streams Fb, Fc which are injected in an angle shallower than that of the first jet stream Fa. The combined jet stream Fx formed by combining the first jet stream Fa reflected by the bottom of the tank 9 and the second jet streams Fb, Fc which deflect the first jet stream Fa downward has an excellent direct advancing property. The combined jet stream Fx prevents the foreign matter arranged on the bottom from whirling-up since the combined jet stream Fx flows along the bottom of the tank 9.

Since the tip opening Ma of the injection hole 5*a* is disposed above the tip openings Mb, Mc of the injection holes 5*b*, 5*c*, the nozzle 1 is capable of forming a thicker combined jet stream Fx (in an up-down direction) than a combined jet stream formed, for example, by a nozzle in which the tip openings Ma, Mb, Mc are disposed in a row. Thus, the combined jet stream Fx can move the foreign matter toward the hopper 11 efficiently.

Since the injection holes 5*a*, 5*b*, 5*c* are disposed in a fan shape in a plan view, the nozzle 1 is capable of forming a wider combined jet stream Fx (in a width direction) than a combined jet stream formed, for example, by a nozzle in which the injection holes 5*a*, 5*b*, 5*c* are disposed parallel to one another.

Thus, the combined jet stream Fx can move the foreign matter toward the hopper 11 efficiently.

The injection holes 5*b*, 5*c* are bent in an blunt angle at some portion between their base ends and front ends to change the injection directions of the second jet streams Fb, Fc. With this configuration, the injection direction of the nozzle 1 can be changed wider than that of a nozzle in which its injection hole is adapted to be straight from its base end to front end and its injection direction is changed according to the direction of the injection hole, even if the length of their injection holes is the same. Thus, an allowable angle range of the injection direction becomes larger in the nozzle 1, which increases the freedom of a layout.

The nozzle 1 also makes it possible to accelerate the speed of the flowing liquid L because the injection holes 5*b*, 5*c* are bent and a fluid passage of the liquid L in an outer portion of each injection hole 5*b*, 5*c* extending from the bent position is longer.

The foreign matter removing device 20 provided with the above-described nozzle 1 injects a jet stream (combined jet stream Fx) which has an excellent advancing property for moving foreign matter to the hopper 11, and the jet stream (combined jet stream Fx) can prevent the foreign matter from whirling up. Thus, the foreign matter removing device 20 can remove the foreign matter from the tank 9 more efficiently than a foreign matter removing device including a conventional nozzle (refer to Japanese utility model application No. H03-43240 and Japanese patent application publication No. 2007-144377, for example).

In accordance with the foreign matter removing device 20, it is also possible to remove the foreign matter from the tank 9 further efficiently because the jet stream (combined jet stream Fx) formed by the nozzle 1 is thick in an up-down direction and wide in a lateral direction.

The foreign matter removing device 20 includes at the bottom of the tank 9 guide grooves 15 extending toward the hopper 11 and being shaped in a circular arc in a cross-section, and the nozzle 1 is disposed at substantially center portion of each guide groove 15 in its width direction. With this configuration, the first jet stream Fa, second jet streams Fb, Fc and the combined jet stream Fx injected from the nozzle 1 can be efficiently guided to the hopper 11. Accordingly, the foreign matter removing device 20 makes it possible to remove the foreign matter from the tank 9 further efficiently.

The embodiment of the present invention has been described above, however, the present invention is not limited to the described embodiment and may be implemented in various embodiments.

In the embodiment, the foreign matter removing device 20 includes four guide grooves 15, however, the number of the guide grooves 15 may be less or more than 4. Further, although it is preferable to include the guide groove 15, the foreign matter removing device 20 of the present invention may include a flat bottom at the bottom of the tank 9 without having the guide grooves 15.

The cross sectional shape of the guide groove 15 of the present invention is preferably a circular arc, however, the cross-sectional shape of the guide groove 15 may be polygonal shape.

In the embodiment, the injection direction of the nozzle 1 is changed by bending the injection holes 5*b*, 5*c* of the nozzle 1 at an blunt angle at some portion between their base end and front end, however, the injection direction of the nozzle 1 of the present invention may be changed by curving the injection holes 5*b*, 5*c*. Further, the nozzle 1 of the present invention may be configured such that the injection holes 5*b*, 5*c* are straight from their base ends to front ends and the injection direction is set according to the directions of the injection holes.

In the embodiment, the nozzle 1 has been described to include the injection hole 5*a* (first injection hole) and the injection holes 5*b*, 5*c* (second injection hole), however, the number of the injection holes is not limited in the present invention as long as the first injection hole and the second injection hole adjacent to the first injection hole are included. For example, the nozzle 1 of the present invention may include the injection hole 5*a* and either one of the injection holes 5*b* and 5*c*.

What is claimed is:

1. A nozzle for injecting jet streams in a tank filled with a liquid, comprising:

a back half of the nozzle including a flow hole through which the liquid flows, the flow hole being in communication with a distribution hole of a liquid distribution pipe; and a front half of the nozzle including a plurality of injection holes communicating with the flow hole of the back of the nozzle, the plurality of injection holes comprising a first injection hole and at east one second injection hole, wherein the first injection hole extends straight and inclines at a first angle to a bottom wall of the tank, wherein the at least one second injection hole comprising:

a first hole portion position extending straight side by side with the first injection hole below the first injection hole; and a second hole portion extending straight and obliquely upward from the first hole portion, the second hole portion extending obliquely relative to the first injection hole and inclining at a second angle to the bottom wall of the tank, the second angle being smaller than the first angle, wherein the first injection hole has an outlet positioned above an outlet of second portion of the at least one second injection hole, wherein the front half of the nozzle injects from the first injection hole a first jet stream directed obliquely at a first injection angle to the bottom wall of the tank, wherein the front half of the nozzle injects from the second hole portion of the at least one second injection hole a second jet stream directed at a second injection angle to the bottom wall of the tank, the second injection angle being smaller than the first injection angle of the first jet stream to the bottom wall of the tank, and wherein a combined jet stream flowing along the bottom wall of the tank is formed in an area in which the second jet stream is merged with the first jet stream, and the area is in front of a position at which the first jet stream is injected against the bottom wall of the tank.

2. The nozzle according to claim 1, wherein the at least one second injection hole is bent upward at a portion between the first hole portion and the second hole portion.

3. The nozzle according to claim 1, wherein said at least one second injection hole comprises two second injection holes, and wherein the two second injection holes extend side by side on both sides of the first injection hole in a plan view, and the two second injection holes are arranged in a fan shape expanding and separated outward from base end sides to front end sides of the two second injection holes in the plan view.

4. The nozzle according to claim 2, wherein said at least one second injection hole comprises two second injection holes, and wherein the two second injection holes extend side by side on both sides of the first injection hole in a plan view, and the two second injection holes are arranged in a fan shape expanding and separated outward from base end sides to front end sides of the two second injection holes in the plan view.

5. A foreign matter removing device for removing a foreign matter settled on a bottom wall of a tank filled with a liquid, comprising:

a hopper which is provided on the bottom wall of the tank to collect the foreign matter;

at least one nozzle to eject jet stream by which the foreign matter is removed toward the hopper, the at least one nozzle being provided in the tank;

a circulation passage to separate the liquid from the liquid mixed with the foreign matter, the liquid mixed with the foreign matter drained from the tank through the hopper, and to return the separated liquid to the at least one nozzle, wherein each of the at least one nozzle comprises:

a back half of the nozzle including a flow hole through which the liquid flows, the flow hole being in communication with a distribution hole of a liquid distribution pipe; and a front half of the nozzle including a plurality of injection holes communicating with the flow hole of the back half of the nozzle, and the plurality of injection holes comprising a first injection hole and at least one second injection hole, wherein the first injection hole extends straight and inclines at a first angle to a bottom of the tank, wherein the at least one second injection hole comprising:

a first hole portion extending straight side by side with the first injection hole below the first injection hole; and a second hole portion extending straight and obliquely upward from the first hole portion, the second hole portion extending obliquely relative to the first injection hole and inclining at a second angle to the bottom wall of the tank, wherein the first injection hole has an outlet positioned above an outlet of the second portion of the at least one second injection hole, wherein the front half of the nozzle injects from the first injection hole a first jet stream directed obliquely at a first injection angle to the bottom wall of the tank, wherein the front half of the nozzle injects from the second hole portion of the at least one second injection hole a second jet stream directed at a second injection angle to the bottom wall of the tank, the second injection angle being smaller than the first injection angle of the first jet stream to the bottom wall of the tank, and wherein a combined jet stream flowing along the bottom wall of the tank is formed in an area in which the second jet stream is merged with the first jet stream, and the area is in front of a position at which the first jet stream is injected against the bottom wall of the tank.

6. The foreign matter removing device according to claim 5, further comprising at least one guide groove on the bottom wall of the tank which extends to the hopper and one end of each of the at least one guide groove connected with the hopper, wherein the at least one guide groove is shaped in a circular arc in a cross section, and each of the at least one nozzle is disposed approximately at a middle of one of the at least one guide groove in a width direction of the one of the at least one guide groove.

7. The foreign matter removing device according to claim 5, further comprising:

at least one guide groove formed on the bottom wall of the tank, the at least one guide groove extending to the hopper, one end of each of the at least one guide groove connected with the hopper, wherein the at least one guide groove has a cross section in a shape of a lower part of a circle or an ellipse whose vertical direction is minor axis direction thereof, a depth of the guide groove being equal to or shorter than a radius of the circle or a semi-minor axis of the ellipse, a ratio of a major axis to a minor axis of the ellipse being equal to or less than eight, and wherein each of the at least one nozzle is disposed approximately at a middle of one of the at least one guide groove in a width direction of the one of the at least one guide groove.

8. A method for removing a foreign matter in a tank with a nozzle, comprising steps of:

preparing a foreign matter removing device comprising:

a hopper which is provided on a bottom wall of the tank to collect the foreign matter;

at least one guide groove on the bottom wall of the tank which extends to the hopper and one end of each of the at least one guide groove connected with the hopper;

at least one nozzle being provided in the tank to inject jet stream by which the foreign matter is removed toward the hopper; and a circulation passage to separate the liquid from the liquid mixed with the foreign matter, the liquid mixed with the foreign matter drained from the tank through the hopper, and to return the separated liquid to the at least one nozzle, wherein the at least one guide groove on is shaped in a circular arc in a cross section, and each of the at least one nozzle is disposed approximately at a middle of one of the at least one guide groove in a width direction of the one of the at least one guide groove in a width direction of the one of the at least one guide groove, and wherein each of the at least one nozzle comprises:

a back half of the nozzle including a flow hole through which the liquid flows, the flow hole being in communication with a distribution hole of a liquid distribution pipe; and a front half of the nozzle including a plurality of injection holes communicating with the flow hole of the back half of the nozzle, wherein the plurality of injection holes include a first injection hole and at least one second injection hole, wherein the first injection hole extends straight and inclines at a first angle to the bottom wall, wherein the at least one second injection hole comprising:

a first hole portion extending straight side by side with the first injection hole below the first injection hole; and a second hole portion extending straight and obliquely upward from the first hole portion, the second hole portion extending obliquely relative to the first injection hole and inclining at a second angle to the bottom wall of the tank, the second angle being smaller than the first angle, and wherein the first injection hole has an outlet positioned above an outlet of the second hole portion of the at least one second injection hole;

injecting a first jet stream directed at a first injection angle to the bottom wall of the tank from the first injection hole; and injecting a second jet stream directed at a second injection angle to the bottom wall of the tank from the second hole portion of the at least second injection hole, whereby a combined jet stream flowing along the bottom wall of the tank by pressing down the first jet stream to the bottom wall by the second jet stream in an area in which the second jet stream is merged with the first jet stream, the area is in front of position at which the first jet stream is injected against the bottom wall of the tank to move a foreign matter settled on the bottom wall of the tank toward the hopper.

9. The method according to claim 8, wherein the first injection hole comprises a straight channel and each of at least one second injection holes is bent upward at a portion between the first hole portion and the second hole portion.

* * * * *